US008082875B2

(12) United States Patent
Henninger et al.

(10) Patent No.: US 8,082,875 B2
(45) Date of Patent: Dec. 27, 2011

(54) DOCTOR DEVICE

(75) Inventors: Christoph Henninger, Heidenheim (DE); Benjamin Mèndez-Gallon, Königsbronn (DE); Ingo Gottwald, Zöschingen (DE); Franz Fischer, Sontheim/Brenz (DE)

(73) Assignee: Voith Patent GmbH, Heidenheim (DE)

( * ) Notice: Subject to any disclaimer, the term of this patent is extended or adjusted under 35 U.S.C. 154(b) by 646 days.

(21) Appl. No.: 11/676,770

(22) Filed: Feb. 20, 2007

(65) Prior Publication Data

US 2007/0144377 A1 Jun. 28, 2007

Related U.S. Application Data

(63) Continuation of application No. PCT/EP2005/053781, filed on Aug. 3, 2005.

(30) Foreign Application Priority Data

Aug. 21, 2004 (DE) ..... 10 2004 040 622

(51) Int. Cl.
*B05C 11/02* (2006.01)
*B05C 17/10* (2006.01)
*B05D 3/00* (2006.01)

(52) U.S. Cl. .. 118/126; 15/245.1; 118/100; 427/428.14; 427/356

(58) Field of Classification Search ..... 118/100, 118/118, 119, 123, 126, 261, 413; 427/428.14, 427/356; 15/245.1
See application file for complete search history.

(56) References Cited

U.S. PATENT DOCUMENTS

| | | | | |
|---|---|---|---|---|
| 3,878,780 | A * | 4/1975 | Lotte | 101/119 |
| 4,220,113 | A | 9/1980 | Wohlfeil | |
| 5,136,967 | A | 8/1992 | Sollinger et al. | |
| 5,284,516 | A | 2/1994 | Sieberth | |
| 5,433,781 | A | 7/1995 | Bernert | |
| 5,605,573 | A | 2/1997 | Salo et al. | |
| 5,766,353 | A * | 6/1998 | Madrzak et al. | 118/126 |

(Continued)

FOREIGN PATENT DOCUMENTS

CN 100515582 C 7/2009

(Continued)

OTHER PUBLICATIONS

European Office Action for EPO serial No. 05773944.3-2124/1789628, dated Aug. 20, 2010. (9 pages).

(Continued)

*Primary Examiner* — Dah-Wei Yuan
*Assistant Examiner* — Charles Capozzi
(74) *Attorney, Agent, or Firm* — Taylor IP, P.C.

(57) ABSTRACT

The present invention provides a doctor device for metering and/or equalizing a liquid-to-pasty medium applied to a running surface, wherein in the case of direct application the surface is a running paper web, paperboard web or other fibrous web and in the case of indirect application a transfer element which transfers the application medium to the fibrous web. The doctor device has a holder arranged on a support beam for accommodating a doctor element used for the metering and/or equalizing. The holder has a first fixed support face bar and a second moving support face bar, wherein to open and close the holder the second support face bar is displaceable respectively away from the first support face bar or toward it such that in the closed state of the holder the doctor element is fixed from the outside and in the open state of the holder it is released.

24 Claims, 3 Drawing Sheets

U.S. PATENT DOCUMENTS

| | | | | |
|---|---|---|---|---|
| 6,202,252 | B1 * | 3/2001 | Harrisson | 15/256.51 |
| 6,637,330 | B1 * | 10/2003 | Nordby et al. | 101/350.6 |
| 6,749,725 | B1 * | 6/2004 | Kirjava et al. | 162/281 |
| 2002/0130470 | A1 * | 9/2002 | Machida | 277/423 |
| 2004/0040498 | A1 | 3/2004 | Parni et al. | |

FOREIGN PATENT DOCUMENTS

| | | | |
|---|---|---|---|
| DE | 28 25 907 | A1 | 12/1979 |
| DE | 39 40 450 | A1 | 6/1991 |
| DE | 3940450 | | 6/1991 |
| DE | 29601342 | | 4/1996 |
| DE | 9109785 | | 10/1999 |
| DE | 199 04 112 | A1 | 8/2000 |
| DE | 19904112 | | 8/2000 |
| DE | 19904112 | A1 * | 8/2000 |
| EP | 1 593 440 | A2 | 11/2005 |
| EP | 1 789 628 | B2 | 1/2011 |

OTHER PUBLICATIONS

Document E1 in Opposition in European Patent Office regarding application No. 05 773 944.3-2124 / patent No. EP 1789628 (1 page). Interlocutory Decision dated Mar. 24, 2010 in Opposition is understood to describe document E1 as an excerpt from "Papier + Folien May 2001", vol. 36, May 2001.

Document E2 in Opposition in European Patent Office regarding application No. 05 773 944.3-2124 / patent No. EP 1789628 (1 page). Interlocutory Decision dated Mar. 24, 2010 in Opposition is understood to describe document E2 as an excerpt from "Allgemeine Papier Rundschau", vol. 125, Nr. 44 of Nov. 5, 2001.

Document E3 in Opposition in European Patent Office regarding application No. 05 773 944.3-2124 / patent No. EP 1789628 (3 pages). Interlocutory Decision dated Mar. 24, 2010 in Opposition is understood to describe document E3 as an excerpt from "La Papeterie", Nr. 245, Dec. 2001, Jan. 2002.

Document E4 in Opposition in European Patent Office regarding application No. 05 773 944.3-2124 / patent No. EP 1789628 (3 pages). Interlocutory Decision dated Mar. 24, 2010 in Opposition is understood to describe document E4 as an excerpt from "Autoblade Buch", year 2000. Document E4 includes pp. 75-77.

Document E5 in Opposition in European Patent Office regarding application No. 05 773 944.3-2124 / patent No. EP 1789628 (7 pages). Interlocutory Decision dated Mar. 24, 2010 in Opposition is understood to describe document E5 as "Preprints", from "Control Systems 94". First page of document E5 states: Control Systems 94, May 31-Jun. 2, Stockholm, Sweden, Conference on Control Systems in the Pulp and Paper Industry, Organizers: Swedish Pulp and Paper Research Institute and The Swedish Association of Pulp and Paper Engineers. Second page of document E5.

Document E6 in Opposition in European Patent Office regarding application No. 05 773 944.3-2124 / patent No. EP 1789628 (3 pages). Interlocutory Decision dated Mar. 24, 2010 in Opposition describes document E6 as Protokoll eines Probelaufs "PM 3 AutoBlade start-up bei Leipa Georg Leinfelder GmbH in Schwedt 23-27.7.2001". Document E6 is dated Jul. 30, 2001 and has a logo for Metso Paper.

Document E7 in Opposition in European Patent Office regarding application No. 05 773 944.3-2124 / patent No. EP 1789628 (5 pages). Document E7 is understood to be an article entitled, "Pigmentieren mit der Filmleimpresse", by Rauno Rantanen, Wochenblatt Fuer Papierfabrikation 6, 1992. Document E7 includes pp. 193-197.

Document E8 in Opposition in European Patent Office regarding application No. 05 773 944.3-2124 / patent No. EP 1789628 (8 pages). Interlocutory Decision dated Mar. 24, 2010 in Opposition describes document E8 as Teräpäällystyksen hallinta 8.—Sep. 12, 1999.

Document E9 in Opposition in European Patent Office regarding application No. 05 773 944.3-2124 / patent No. EP 1789628 (6 pages). Document E9 is understood to be an article entitled, "Pigmenting and soft calendering of printing papers", by Risto Turunen, in vol. 76, No. 12 Tappi Journal (apparently pp. 87-92), Dec. 1993.

Document E10 in Opposition in European Patent Office regarding application No. 05 773 944.3-2124 / patent No. EP 1789628 (3 pages). Interlocutory Decision dated Mar. 24, 2010 in Opposition is understood to describe document E10 as a brochure entitled "CombiBlade" from Voith Paper.

Document E11 in Opposition in European Patent Office regarding application No. 05 773 944.3-2124 / patent No. EP 1789628 (4 pages). Interlocutory Decision dated Mar. 24, 2010 in Opposition is understood to describe document E11as an excerpt from "Pigment Coating and Surface Sizing of Paper", chapter 24. Second page of Document E11 indicates document E11 was published by Fapet Oy of Helsinki, Finland, with copyright of 2000.

Document S1 in Opposition in European Patent Office regarding application No. 05 773 911.3-2124 / patent No. EP 1789628 (5 pages). Interlocutory Decision dated Mar. 24, 2010 in Opposition describes document S1 as a copy of the "Sückliste der Planung" betreffend die mit Schwedt PM3 bezeichnete Papiermachine.

Document Z1 in Opposition in European Patent Office regarding application No. 05 773 944.3-2124 / patent No. EP 1789628 (1 page). Interlocutory Decision dated Mar. 24, 2010 in Opposition describes document Z1 as Konstruktionszeichnung COA 1017671.01 1(2). Konstruktionszeichnung is understood to be a construction drawing.

Document Z2 in Opposition in European Patent Office regarding application No. 05 773 944.3-2124 / patent No. EP 1789628 (1 page). Interlocutory Decision dated Mar. 24, 2010 in Opposition describes document Z2 as Konstruktionszeichnung COA 1017671.01 2(2). Konstruktionszeichnung is understood to be a construction drawing.

Document Z3 in Opposition in European Patent Office regarding application No. 05 773 944.3-2124 / patent No. EP 1789628 (1 page). Interlocutory Decision dated Mar. 24, 2010 in Opposition describes document Z3 as Konstruktionszeichnung COA 1017707.00 1(2). Konstruktionszeichnung is understood to be a construction drawing.

Document Z4 in Opposition in European Patent Office regarding application No. 05 773 944.3-2124 / patent No. EP 1789628 (1 page). Interlocutory Decision dated Mar. 24, 2010 in Opposition describes document Z4 as Konstruktionszeichnung COA 1017708.02 1(1). Konstruktionszeichnung is understood to be a construction drawing.

Document Z5 in Opposition in European Patent Office regarding application No. 05 773 944.3-2124 / patent No. EP 1789628 (1 page). Interlocutory Decision dated Mar. 24, 2010 in Opposition describes document Z5 as Konstruktionszeichnung Details. This is understood to be construction drawing details.

Document Z6 in Opposition in European Patent Office regarding application No. 05 773 944.3-2124 / patent No. EP 1789628 (1 page). Interlocutory Decision dated Mar. 24, 2010 in Opposition describes document Z6 as Konstruktionszeichnung COA 1017710.00 1(3). Konstruktionszeichnung is understood to be a construction drawing.

Document Z7 in Opposition in European Patent Office regarding application No. 05 773 944.3-2124 / patent No. EP 1789628 (1 page). Interlocutory Decision dated Mar. 24, 2010 in Opposition describes document Z7 as Konstruktionszeichnung COA 1017710.00 1(3). Konstruktionszeichnung is understood to be a construction drawing.

Document entitled, "Affidavit of Mr. Heikki Vatanen", dated Oct. 15, 2008.

Document in Opposition in European Patent Office regarding application No. 05 773 944.3-2124 / patent No. EP 1789628 (1 page). Document has the following heading: Englische Uebersetzung der in Z3 and Z4 verwendeten finnischen Begriffe. This is understood to refer to an English translation of Finnish words in documents Z3 and Z4, Oct. 2008.

International Search Report dated Nov. 16, 2005 for PCT/EP2005/053781 (6 pages).

English translation of International Preliminary Report on Patentability dated Feb. 28, 2007 for PCT/EP2005/053781 (7 pages).

English translation of Written Opinion of the International Searching Authority for PCT/EP2005/053781 (6 pages).

* cited by examiner

DOCTOR DEVICE

CROSS REFERENCE TO RELATED APPLICATIONS

This is a continuation of PCT application No. PCT/EP2005/053781, entitled "DOCTOR BLADE DEVICE", filed Aug. 3, 2005.

BACKGROUND OF THE INVENTION

1. Field of the Invention

This invention relates to a doctor device for metering and/or equalizing a liquid-to-pasty medium applied to a running surface, wherein in the case of direct application the surface is a running paper web, paperboard web or other fibrous web and in the case of indirect application a transfer element which transfers the application medium to the fibrous web. The doctor device has a holder arranged on a support beam for accommodating a doctor element used for the metering and/or equalizing.

2. Description of the Related Art

Doctor devices of this type are used in conjunction with applicators which, as previously mentioned, are suitable for direct or indirect application. The liquid or pasty medium for application is applied onto the fibrous web by way of a pressurized compartment with the help of a doctor element constructed as a doctor rod, a doctor bar or a doctor blade for example. Also known are doctor devices for use in finish-metering devices, with which a layer of liquid or pasty medium previously applied to the fibrous web is finish-metered to a predefined quantity. The finish-metering is performed likewise by way of one of the above mentioned doctor elements. However, the doctor device can also be used solely to even out, meaning equalize, the medium previously applied in the required quantity.

In the case of conventional applicators or finish-metering devices the doctor element is fastened with the help of comparatively complex constructional solutions. The geometrically correct seating of the doctor element, for example a doctor blade, is assured with a system of guide bars, support bars, clamping bars and pressure bars. On conventional constructions the numerous bar elements and additional components are screwed together. The known constructions thus have very many individual parts which are exposed on the one hand to a high temperature and on the other hand directly to the coating medium and require a corresponding assembling and dismantling effort in order to clean the doctor device.

From DE 9109785 U1 there is known a doctor device with a holding bar for accommodating a doctor blade, wherein the holding bar in the direct clamping region of the blade and/or in a region adjacent thereto is constructed to be flexible in the direction transverse to the blade but relatively rigid in the direction of the blade's width in order to guarantee as free a deformation of the blade as possible over its entire width. By contrast the foot region of the holding bar, which is used for fixing to a fastening base, is constructed to be rigid. The holding bar usually includes several individual parts, together forming an integrated unit, which are arranged separate from the actual support beam of the doctor device but on it.

From DE 296 01 342 U1 there is also known a doctor unit with a holding bar and a doctor element fitted thereto, wherein said element can be placed against or inserted into a support beam by way of mutually matching support faces. In this case provision is made for an apparatus with which a holding force can be applied, thus pulling or sucking the holding bar against the support beam when it is placed against or inserted into the support beam by way of the support faces. The apparatus is constructed such that the holding force can be deactivated and reactivated.

In addition, from DE 39 40 450 A1 there is known a doctor device equipped with a seat for a leaf spring, which either acts as a doctor element or is connected thereto and which in its region away from the coating edge of the doctor element can be clamped in place by a clamping element which presses the leaf spring against a support face. In the clamping region provision is made on the seat of the leaf spring for a duct running parallel to the coating edge, wherein a series of vibration pulse transmitters is arranged along the length of the duct and enables cleaning of the blade seat. By using vibrations to remove any adhering residues of the coating medium it is intended to guarantee that the coating blade sits correctly in its clamping arrangement.

The devices known hitherto often provide only poor possibilities for cleaning because the interior space is impossible to view and difficult to reach. This results in a great servicing effort because numerous parts have to be dismantled in order to reach inner lying parts for cleaning.

What is needed in the art is a doctor device which is simple in design and provides optimum access to all functional parts for cleaning or servicing and can be quickly dismantled and reassembled.

SUMMARY OF THE INVENTION

The present invention provides a doctor device which has a holder with a first, fixed support face bar and a second, moving support face bar. To open the holder in order to obtain optimum access to all functional parts of the doctor device holder and to remove the doctor element, the moving support face bar is displaceable outwards (in the direction of the running surface) from the fixed support face bar. In the closed state of the holder the doctor element is clamped between the fixed and the moving support face bar.

The holder for accommodating the doctor element (e.g. a machine-wide doctor blade or a rotatable doctor rod mounted on a blade-shaped support element in a doctor bed) and other functional units are arranged independently of each other on a support beam. In this case provision is made for the first, fixed support face bar and the second, moving support face bar of the holder to fix the doctor element upon application of force such that said element, in the operating state, wipes off and/or equalizes coating color applied to the fibrous web. The holder can be constructed such that the fixed support face bar is arranged on the inside and is connected to the support beam. Over its longitudinal extension this support face bar can be penetrated to a greater or less extent with recesses and through-holes over the entire width of a coating device. The moving support face bar can be opened in the direction of the running surface to be coated or an opposing roller such that in the opened state it frees the doctor element on the one hand and provides enough space for cleaning the holder elements on the other hand. In the servicing state, meaning with the holder opened, an unobstructed discharge of coloring and cleaning agents through additional, for example lateral openings such as outlet bores or slits is likewise assured.

An essential advantage of the present invention thus lies in its optimum access for cleaning the doctor device holder. All functional parts of the doctor device and the inner lying parts such as hoses and moving parts can be viewed directly. An unobstructed discharge of coloring agent is also assured, as described above, when the holder is open. The doctor device according to the present invention has a simplified construction and, in addition, can be quickly dismantled and reassembled. Furthermore, a difference in thermal expansion is compensated because the doctor device holder itself and a pressure bar existing above the fixed support face bar for pressing on the doctor element are not rigidly connected. Hence at least one of the bars can expand freely.

According to an embodiment of the present invention, provision is made for the support face bar to be equipped with slide faces. Slide faces can be constructed on the common contact faces of the support face bar and the support beam, which represent a linear guide. In this case the linear guide is constructed in its tolerances such that no detrimental quantities of coating medium or other contaminants can get onto the bearing faces which are in contact with each other. Furthermore, the moving support face bar can expand freely under thermal loading.

The tolerances of the linear guide guarantee that the doctor element is accommodated and clamped with high accuracy and with precision. The tolerances lie in the range from 0 to 1 mm, preferably 0 to 0.4 mm.

A low-friction and low-wear material is the primary choice of material for the respective slide faces. In addition, the material should also withstand the thermal loads arising on the doctor element and should also be insensitive to residues of the coating medium. Suitable slide faces are included advantageously of bearing metal or plastic which have a low coefficient of friction and can be used primarily without lubricant.

On an embodiment of the present invention, the moving support face bar can be constructed with three legs which surround the fixed support face bar in U-shape, wherein the first (vertical) leg represents the actually moving support face bar and clamps, in the closed state of the holder, the doctor element on the fixed support face bar. The second (vertical) leg is arranged inside the holder and can be pressurized with the holding force for the doctor element, and the third (horizontal) leg joins the first and the second leg rigidly together. In this case the third leg, which, as said, in the U-shaped configuration corresponds to the horizontal part, can be passed linearly through recesses in the lower region of the fixed support face bar such that it makes contact with the top side of the support beam and is slidingly mounted. The application of force on the second leg is thus transferred via the connecting third leg onto the first leg in order to hold the doctor element there accordingly tightly.

A similarly advantageous variant provides for two pressure hoses resting inside the doctor device to be arranged on both side faces of the second leg in order to move the support face bar and to create the holding force. In this case the first pressure hose, which applies the closing force for fixing the doctor element, can rest against a side face of the support face bar rigidly connected (fixed) to the support beam. The second pressure hose, which releases the doctor element for changing the blade or for carrying out servicing work, can rest against the side face of another supporting and holding bar, which as a rule is connected likewise rigidly to the support beam. Either the first or the second pressure hose, depending on the operating state, can be pressurized with compressed air to move the support face bar in the linear guide. Similarly the holding force, which in the operating state presses the doctor element against the fixed support face bar, is defined by the pressurization of the pressure hose resting against the rear side face of the support face bar.

Alternatively, it is possible advantageously for hydraulic or pneumatic cylinders to be arranged to move the push bar and to create the holding force. Such apparatuses are suitable for linearly slidable as well as for pivotable embodiments of the moving support face bar for fixing the doctor element. Hydraulic or pneumatic cylinders offer free scope for designing the construction of the doctor device.

According to another embodiment of the invention, a pressure bar for the doctor element can be arranged above the holder in order to apply pressure with an additional force, wherein the pressure bar and the holder are not rigidly connected to each other. A coating blade for example is pressed by the force generated by way of a pressing apparatus against an opposing roller for example in order to establish the layer or coating thickness when applying color to the fibrous web. The pressure bar and the holder, which are not rigidly connected to each other, can expand respectively under thermal loading independently of each other.

Similarly, it is possible advantageously for the pressure bar to be segmented. The application of force can thus be controlled over the entire length of the doctor element on a zonal basis and free of thermal distortions.

It is possible advantageously for the external contour of the holder and/or the pressure bar to be sealed free of play against soiling by way of at least one removable cover plate. Such an enclosure or encapsulation of the doctor device prevents in particular the accumulation of stubborn residues of the coating medium used. For servicing and cleaning the device the at least one cover plate is quickly removed and fitted again by way of quick-release fasteners. Removing the cover provides optimum access to all parts lying inside, in particular hoses and moving parts.

An expedient embodiment of the cover plate can include being manufactured from a flexible spring steel. In the fitted state a defined force is exerted on the pressure bar by pre-tensioning of the spring steel. The pre-tensioning is generated by way of fixing screws which can be arranged in a row in the center of the cover, i.e. in the center of the spring metal sheet.

The thickness of the cover or cover plate or spring metal sheet should be 0.2 to 8 mm, preferably 0.5 to 4 mm.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
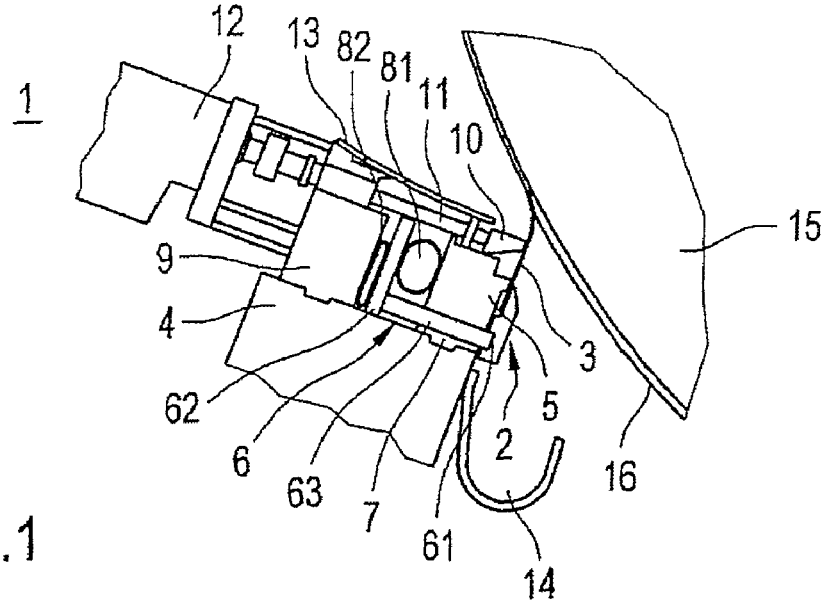
FIG. 1 shows a schematic illustration of a doctor device according to the present invention of an applicator of a coating machine.

Referring now to the drawings, and more particularly to FIG. 1, there is shown a doctor device 1 of a direct applicator of a coating machine, on which a doctor element 3 in the form of a machine-wide blade is placed against an opposing roller 15. In this case the doctor element 3 wipes off or equalizes, to the required coating thickness (coating weight in g/m$^2$), the excess coating medium applied to a running paper web, paperboard web or other fibrous web 16 enwrapped around the opposing roller 15 on at least a part of its circumference. The wiped off coating medium is directed through a color return line 14 for further use. The doctor element 3 is fixed in a holder 2. The holder 2 includes a fixed support face bar 5 and a moving support face bar 6. The support face bar 5 is arranged on a support beam and optionally detachable, for example by way of holding elements.

The support face bar 5 occupies an inside position in the doctor device 1. The support face bar 6 is slidingly positioned such that it can be moved away from the inner lying support face bar 5 by way of a linear guide. Illustrated in FIG. 1 is the sliding-bearing linear guide, including a third leg 63 of the on the whole U-shaped support face bar 6, with corresponding sliding faces 7. Arranged above the holder 2 is a pressure bar 10 with which the doctor element 3 can be pressurized with additional force. The force is transmitted to the pressure bar 10 via a stroking bar 11 of the externally arranged stroking apparatus 12. The pressure bar 10 and the holder 2 are not rigidly connected to each other. Not shown in the figures is the segmentation of the pressure bar 10, which extends into the depth of the illustration.

The moving pressure bar 6 is constructed on the whole from three legs 61, 62, 63, which surround the fixed support face bar 5 in U shape. The first leg 61 forms the actual support face which fixes the doctor element 3 from the outside. In other words, the vertical leg 61 is arranged on the outside in the direction of the opposing roller 15 and holds the doctor element 3 by pressing it against the fixed support face bar 5. Two pressure hoses 81 and 82 resting inside the doctor device 1 are arranged on both side faces of the second vertical leg 62 and can be pressurized respectively with compressed air in order to create and release the holding force. The first pressure hose 81 is used for fixing and the second pressure hose 82 for releasing the clamping effect.

The support face bar 6 with its three legs 61, 62 and 63 can be constructed in one piece, but a two-part construction is also possible. In the latter case, meaning on the two-part variant, the bar 6 would include the second vertical leg 62 and an angular component, with the first and third leg 61 and 63 forming this angular common component.

Figure 2:
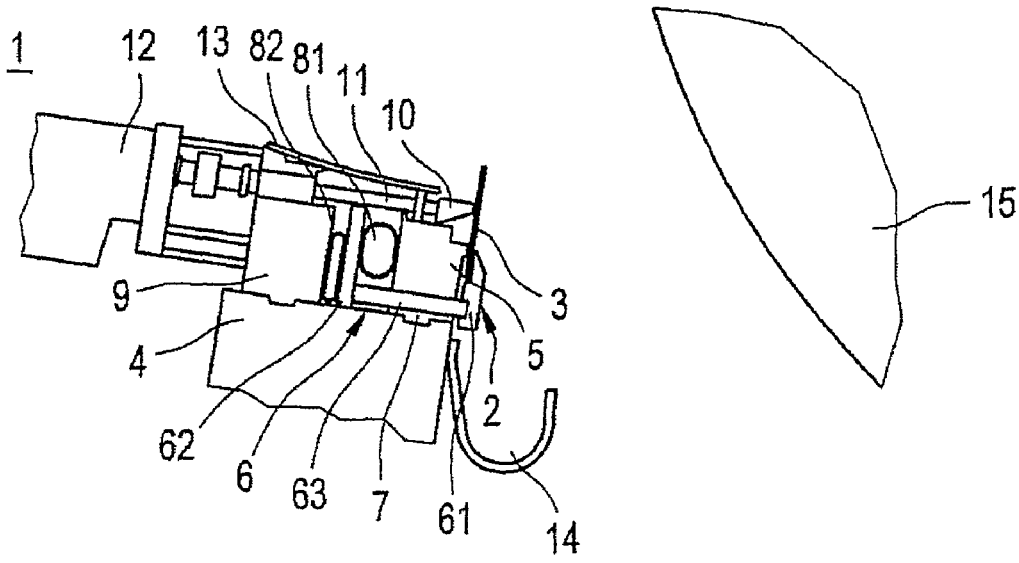
FIG. 2 shows the position of a doctor device during servicing work in relation to an opposing roller.

In FIG. 2 the doctor device 1 is moved away from the opposing roller 15 for servicing work, as the result of which the entire frontage facing the opposing roller 15 becomes accessible. In particular the doctor element 3 and the parts of the holder 2 are freely accessible from there.

Figure 3:
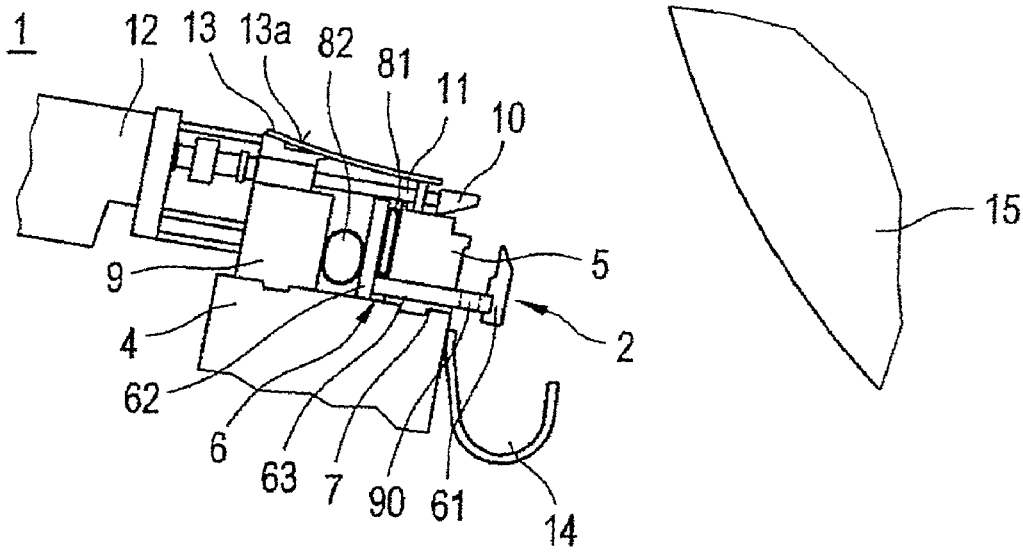
FIG. 3 shows a schematic illustration of a doctor device whose push bar is open toward the opposing roller.

Like FIG. 2, FIG. 3 shows the doctor device 1 swung away from the opposing roller 15 for cleaning or servicing purposes, but with the holder 2 opened toward the opposing roller 15 and with the support face bar 6 extended. Only the second pressure hose 82, which rests against the supporting and holding bar 9, is pressurized with compressed air for opening. The clamping action of the first leg 61 is thus canceled and the doctor element 3 released via the third leg 63 which is constructed as a linear guide. Hence the doctor element 3, which is constructed as a doctor blade, is included in the drawing in this position.

Thanks to a removable cover plate 13, which can include a pretensioned, flexible spring metal sheet and arranged above the pressure bar 10, the doctor device 1 is freely accessible also from the top side after the plate 13 is removed. Contaminants are thus better to remove from the inside of the device and servicing jobs are easier to perform. Thanks to this flat design it is also possible to perform better quality control with regard to detecting and eliminating unwanted doctor blade streaks because you now have access and a view right through to the doctor element and blade tip.

The surface 13*a* of the cover plate 13 is constructed such that it is either insensitive to soiling or easy to clean. For example, this surface 13*a* can be either cold-rolled or polished or ground. Similarly it can be coated with an anti-adhesive medium such as PTFE (Teflon), from which any soiling runs off or is easier to remove. Additional or alternating cooling, for example by way of incorporated cooling ducts, also prevent contaminants from sticking to the surface.

It should also be noted that the third leg 63 of the contact face bar 6 can have openings 90 such as bores, slits or slots in order for the coating medium and, during servicing jobs, cleaning water to run out unobstructed.

Figure 4:
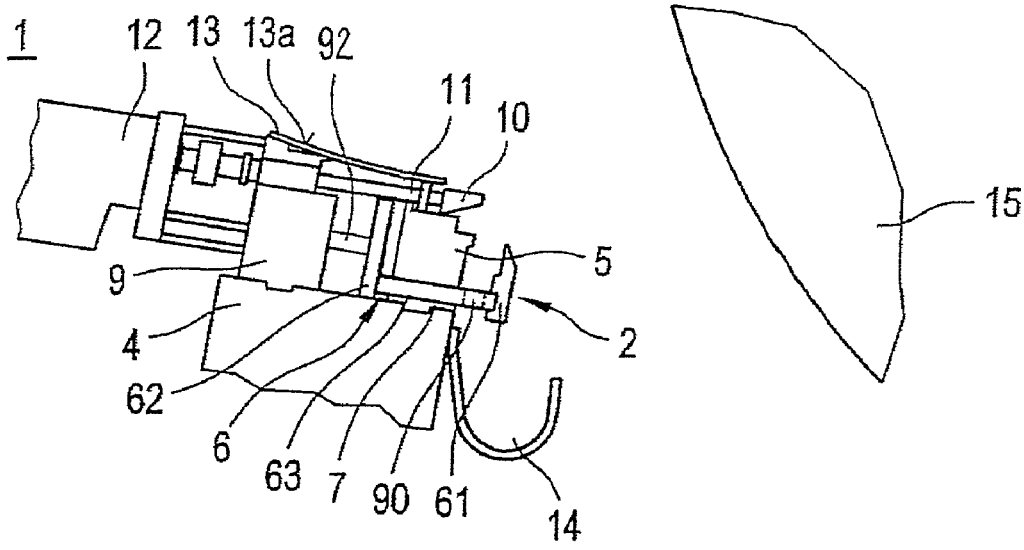
FIG. 4 shows a schematic illustration of a doctor device including a hydraulic or pneumatic cylinder.

According to another embodiment of the present invention as shown in FIG. 4, a hydraulic or pneumatic cylinder 92 can be arranged to move support face bar 6 and to create the holding force.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 Doctor device
2 Holder
3 Doctor element
4 Support beam
5 First support face bar
6 Second support face bar
61 First leg
62 Second leg
63 Third leg
7 Sliding face
81 First pressure hose
82 Second pressure hose
9 Supporting and holding bar
10 Pressure bar
11 Stroking bar
12 Stroking apparatus
13 Cover plate
13*a* Surface of cover plate
14 Color return line
15 Opposing roller
16 Fibrous web
90 Openings
92 Hydraulic or pneumatic cylinder

What is claimed is:

1. A doctor device for at least one of metering and equalizing a liquid-to-pasty medium applied to a moving surface, which in a case of direct application the surface is a running fibrous web and in a case of indirect application the surface is a transfer element which transfers the application medium to the fibrous web, said doctor device comprising:

a support beam including an exterior surface;

a doctor element; and a holder arranged on said support beam for accommodating said doctor element for at least one of the metering and the equalizing, said holder including a fixed first support face bar and a moving second support face bar, said holder movable between an open position and a closed position, to open and close said holder said second support face bar being displaceable respectively one of away from and toward said first support face bar, in said closed position of said holder said doctor element being fixed from outside, in said open position of said holder said doctor element being released, said fixed first support face bar being detachable from said support beam, said second support face bar including a plurality of through-holes in order for at least one of a coating medium and a cleaning water to run out unobstructed in said open position of said holder, said moving second support face bar being slidingly mounted to said exterior surface of said support beam.

2. The doctor device according to claim 1, wherein in said open position of said holder said second support face bar is movable away by said first support face bar in a direction of the running surface, said first support face bar being fixed to said support beam.

3. The doctor device according to claim 1, further comprising a plurality of sliding faces, wherein said second support face bar is mounted on highly accurate said plurality of sliding faces.

4. The doctor device according to claim 3, wherein said plurality of sliding faces include one of a metal and a plastic.

5. The doctor device according to claim 3, wherein said second support face bar and said plurality of sliding faces forms a sliding pair, on said sliding pair a plurality of permitted tolerances lie in a range from 0 to 1 mm.

6. The doctor device according to claim 3, wherein said second support face bar and said plurality of sliding faces forms a sliding pair, on said sliding pair a plurality of permitted tolerances lie in a range from 0 to 0.4 mm.

7. The doctor device according to claim 1, wherein said moving second support face bar includes three legs which surround said fixed first support face bar in a U-shape, said three legs including a first leg, a second leg, and a third leg, said first leg fixing said doctor element to said first support face bar, said second leg being arranged parallel to said first leg, said second leg being pressurized with a holding force for said doctor element, said third leg connecting said first leg and said second leg rigidly to each other.

8. The doctor device according to claim 7, further comprising two pressure hoses, said second leg including two side faces, said two pressure hoses arranged on both said side faces of said second leg in order to move said second support face bar and to create said holding force.

9. The doctor device according claim 7, further comprising one of a hydraulic cylinder and a pneumatic cylinder arranged to move said second support face bar and to create said holding force.

10. The doctor device according to claim 7, wherein said second support face bar includes on the whole two parts including a first part, said first part including a single angular component, said single angular component including said first leg and said third leg.

11. The doctor device according to claim 7, wherein said second support face bar includes on the whole one piece.

12. The doctor device according to claim 1, further comprising a pressure bar for said doctor element, said pressure bar arranged above said holder in order to apply pressure with an additional force, said pressure bar and said holder not being rigidly connected to each other.

13. The doctor device according to claim 12, wherein said pressure bar is segmented.

14. The doctor device according to claim 12, further comprising at least one removable cover plate, wherein at least one of an external contour of said holder and said pressure bar is sealed against soiling by said at least one removable cover plate.

15. The doctor device according to claim 14, wherein said cover plate includes a flexible spring steel.

16. The doctor device according to claim 15, wherein said cover plate is formed from a flexible spring steel sheet.

17. The doctor device according to claim 14, wherein said cover plate has a thickness of 0.2 to 8 mm.

18. The doctor device according to claim 14, wherein said cover plate has a thickness of 0.5 to 4.0 mm.

19. The doctor device according to claim 14, wherein said cover plate includes a top side which is at least one of insensitive to soiling, anti-soiling, and easy to clean.

20. The doctor device according to claim 19, wherein said top side of said cover plate is one of cold-rolled, polished, and ground.

21. The doctor device according to claim 19, wherein said top side of said cover plate includes a coating of an anti-adhesive medium.

22. The doctor device according to claim 21, wherein said anti-adhesive medium includes polytetrafluoroethylene.

23. The doctor device according to claim 19, wherein said top side of said cover plate is configured for being cooled.

24. The doctor device according to claim 1, wherein said third leg of said second support face bar includes a plurality of openings in order for at least one of a coating medium and a cleaning water to run out unobstructed in said open position of said holder.

* * * * *